United States Patent [19]

Ziegelmeyer

[11] 4,156,949

[45] Jun. 5, 1979

[54] PIPE CLEANING MACHINE

[76] Inventor: Lynn J. Ziegelmeyer, P.O. Box 752, Shady Cove, Oreg. 97539

[21] Appl. No.: 635,907

[22] Filed: Nov. 28, 1975

[51] Int. Cl.[2] ..... A46B 13/02; B08B 9/02

[52] U.S. Cl. ..... 15/88; 51/236

[58] Field of Search ..... 15/88, 104.04; 118/DIG. 11, 72; 51/66, 79, 89, 105 R, 118, 236, 103 TF

[56] References Cited

U.S. PATENT DOCUMENTS

| | | | |
|---|---|---|---|
| 2,353,125 | 7/1944 | Carpmail | 15/88 |
| 3,121,898 | 2/1964 | Morain | 15/88 |
| 3,210,788 | 10/1965 | Holliday | 15/88 |
| 3,434,610 | 3/1969 | Wilson | 51/79 X |
| 3,702,489 | 11/1972 | Nakamura | 15/88 |

*Primary Examiner*—Edward L. Roberts

*Attorney, Agent, or Firm*—Clarence M. Crews

[57] ABSTRACT

A pipe cleaning machine is provided in which rotary wire brushes remove rust and/or dirt from the exterior of pipes of various diameters. Feeding means is provided for driving the pipe lengthwise while rotating it. Provision is made of optionally usable means for reversing the direction of travel of the pipe if it is seen to require further cleaning after one or more passes. It is a feature that through a simple adjustment the number of turns per foot of pipe advancement may be varied, a feature of importance in relation to different diameters of pipe and to the observed need for increasing or diminishing the intensity of total treatment. The capacity for reversal of travel is important for continuing treatment of the pipe until the observed degree of cleanliness is acceptable. Reversal of travel can also simplify the handling of the pipe for a single attendant because the cleaned pipe can be withdrawn at the same end of the machine from which the rusted or dirty pipe is fed in.

3 Claims, 7 Drawing Figures

PIPE CLEANING MACHINE

This invention relates to a machine for removing rust and/or dirt from the exterior surfaces of pipes of various diameters.

Pipes of rustable composition quickly acquire a coating of rust when exposed to the weather. This is of slight concern if the pipe is not to be painted and is not to be exposed to view or to the weather in use. In most instances, however, purchasers of pipe from pipe manufacturers, or distributors, prefer to receive the pipe in a rust-free and dirt-free condition, and the satisfying of this preference demands that pipe which has accumulated a coating of rust and/or of dirt be cleaned before delivery to a customer.

The machine proper includes rotary wire brushes for scouring the pipe surface as the pipe is simultaneously rotated and fed lengthwise through the machine.

If we consider pipes of different diameters which require equal scrubbing treatment by the brushes, per unit area, it is obvious that the larger pipe requires more extended cleaning exposure per foot of advance than the smaller pipe. Provision is accordingly made for varying the number of revolutions per foot of advance as required.

The practical requirements seldom fit exactly such an idealized relationship, but the provision for varying the number of revolutions per foot of advance can be adjusted through a broad range to satisfy what are observed to be practical requirements.

Whenever a length of pipe has been fed through the machine, or through and back, without having achieved the desired degree of cleaning, the operation may be repeated, and if desired the machine may be set to increase or diminish the number of revolutions of the pipe per foot of longitudinal travel of the pipe.

Other objects and advantages will hereinafter appear.

In the drawing forming part of this specification,

Figure 1:
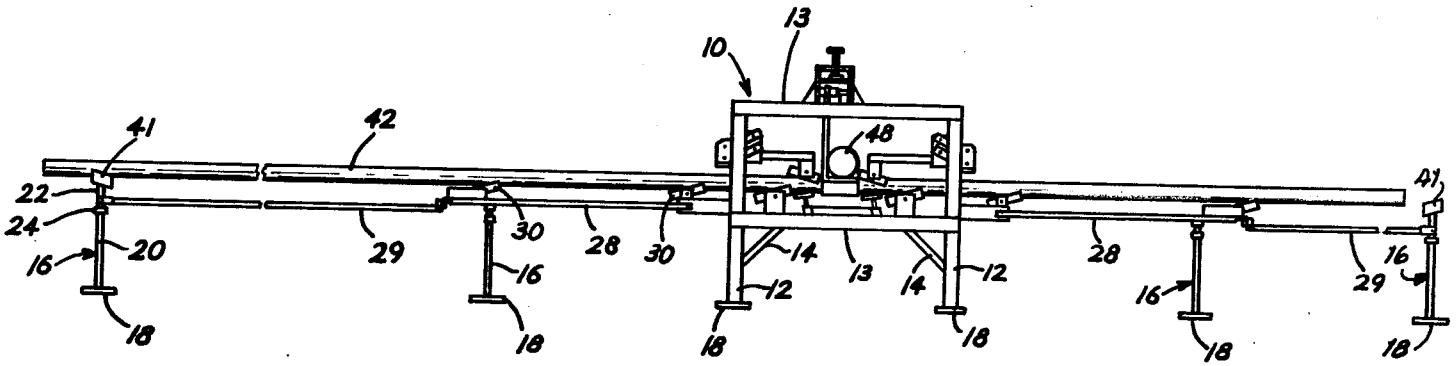
FIG. 1 is a view in side elevation of a practical and advantageous embodiment of my novel machine with feed-in and feed-out, idler pipe supports at either end; the latter being broken away intermediate their ends for compactness of illustration.
Figure 2:
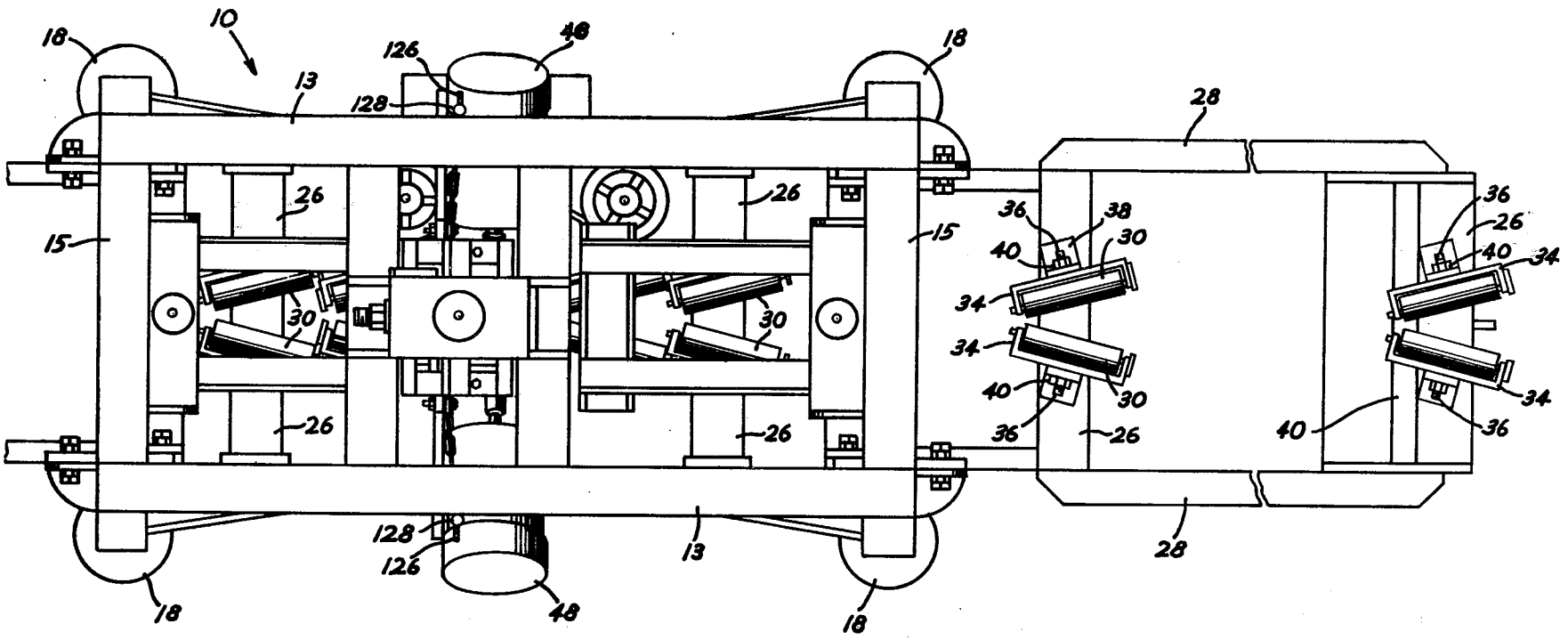
FIG. 2 is a plan view of the significant mechanism of the machine, together with only a restricted portion of what will be the feed-out mechanism, if the feed is not reversed or is reversed an even number of times.
Figure 3:
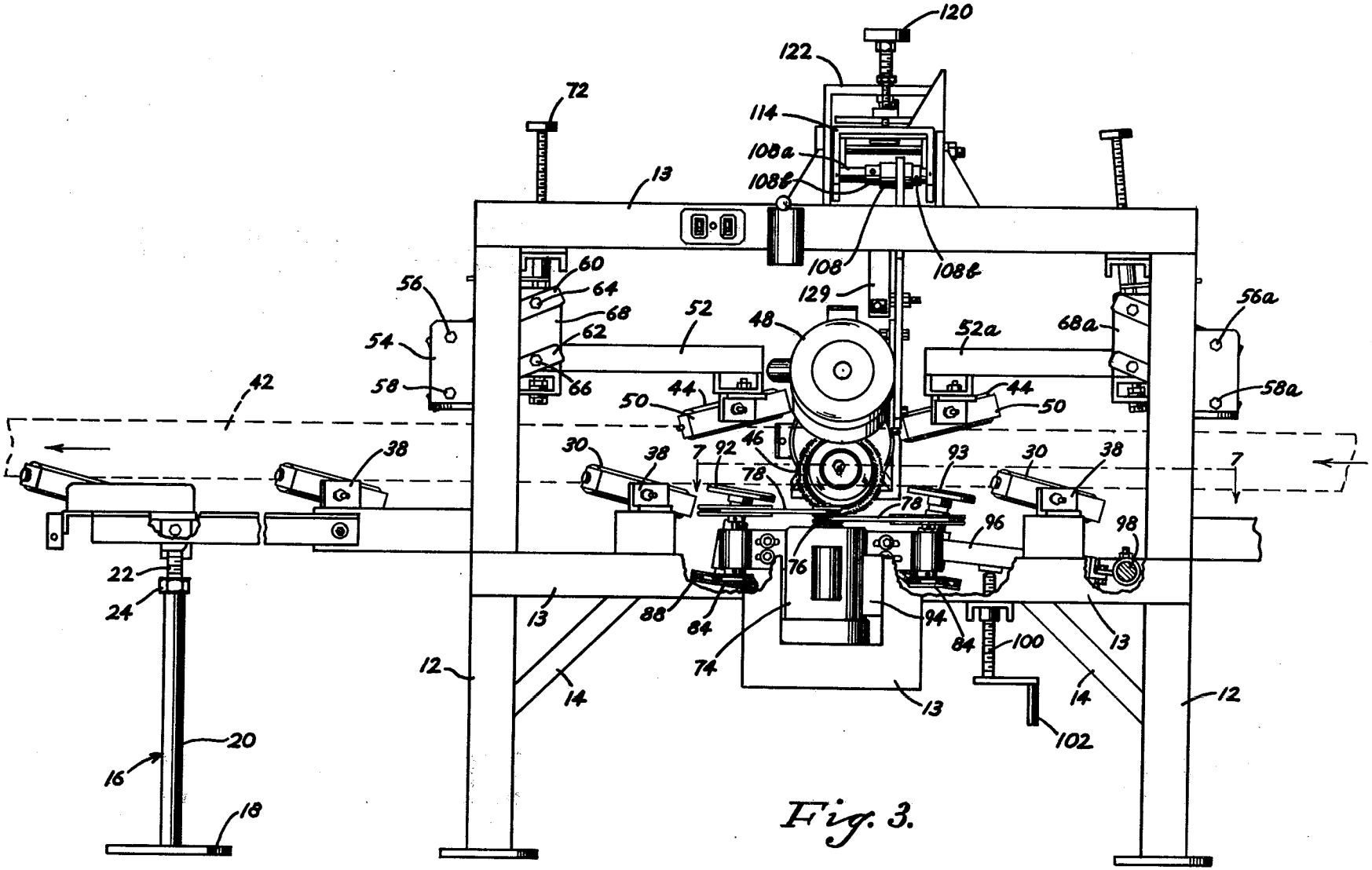
FIG. 3 is a view in side elevation of the significant portion of the machine together with a fragment of the "feed-out" conveyor.
Figure 5:
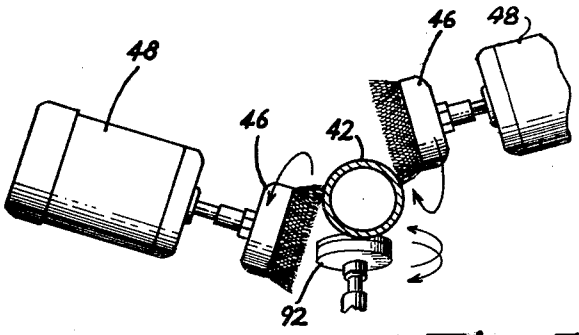
FIG. 5 is a detail view in end elevation showing principally the brushes and the brush motors, together with one of the feed discs.
Figure 6:
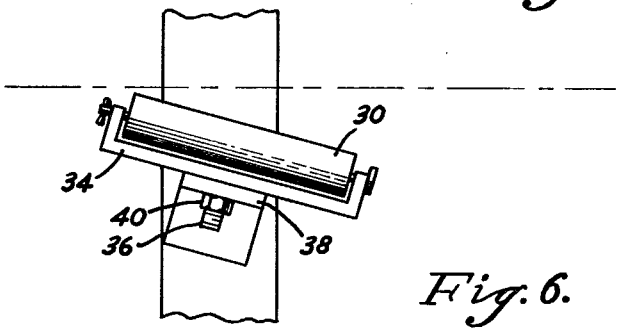
FIG. 6 is a plan detail view of one of the support rollers.
Figure 4:
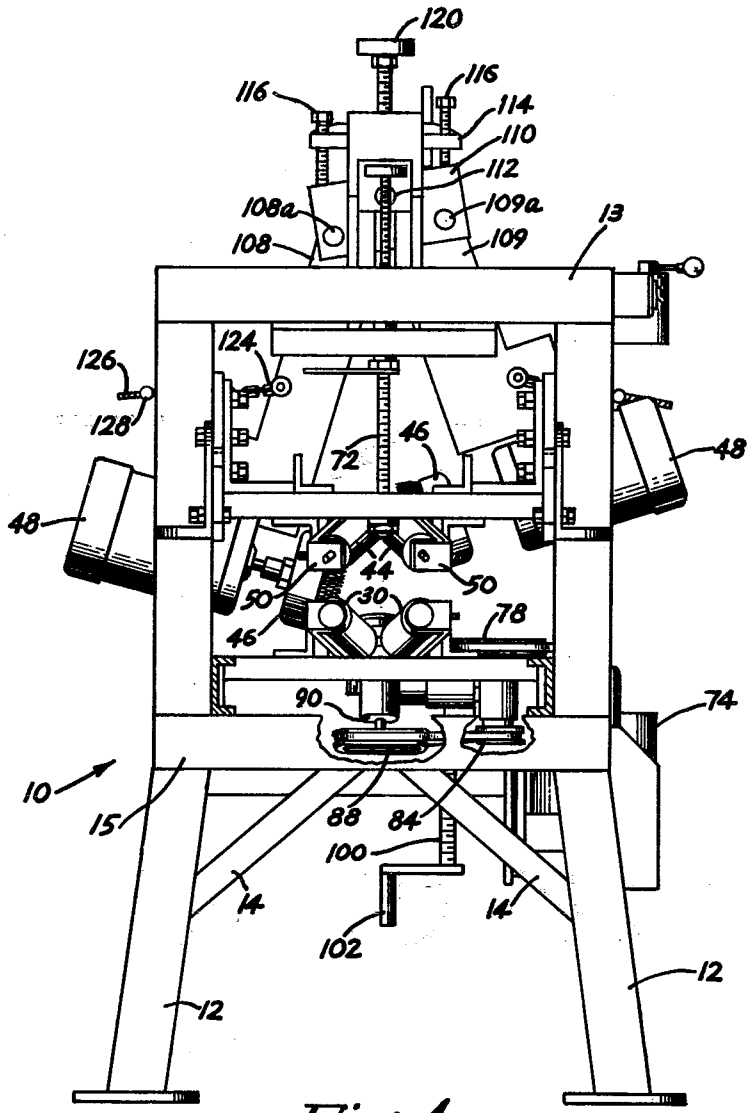
FIG. 4 is an end view of the machine as seen from the "output" end.

The novel machine comprises a framework 10 consisting chiefly of uprights 12, longitudinal horizontal members 13, connecting braces 14 and transverse horizontal members 15, all rigidly and fixedly united.

At the left and right of the machine proper, pipe runways are provided, each comprising upright posts 16 supported on pads 18.

Each post 16 is desirably adjustable in height, and consists of a lower hollow section 20, an upper externally threaded section 22 which can be received in the lower section 20, and a nut 24 which rests on the lower section 20 and is threaded onto the threaded section 22.

The posts 16 are arranged in rows, along the center line at opposite ends of the machine. The posts 16 are connected to one another by longitudinally extending bars 28 and 29.

Between the posts 16 to the right and left and in the machine proper bars 26 desirably carry pairs of opposed idler rollers 30. Each roller is rotatively supported in a U-shaped bearing member 34, which member includes a threaded supporting stem 36. The threaded stem 36 extends horizontally through an upstanding portion of an angle bracket 38, which bracket is affixed to the cross-member 26. Each bearing member 34 is fixed in position by a nut 40. The angular tilt of a roller 30 can be adjusted as desired by backing off the associated nut 40, changing the tilt of bracket 34, and re-tightening the nut.

Normally, however, the tilt of all the rollers is the same and, once set, the tilt is not disturbed.

The roller supporting brackets desirably cause the rollers to diverge toward their upper ends by a uniform angle which may desirably be of the order of thirty degrees, as shown. The rollers are desirably set so that their divergent ends tilt uniformly upward at a slope of the order of fifteen degrees.

Beyond the sections referred to the bars 29 carry upwardly facing angle bars 41 which provide troughs to support and guide the pipe and guard it against bending.

Idler pipe supporting rollers 30, similar to those already described, are included in the main machine and at each side of the machine for completing the roller supporting trackway where roller support of the pipe is required. The rollers 30 are made freely rotatable simply in the interest of reducing frictional resistance to the rotational and longitudinal movements of the pipe 42, which they support for cleaning.

The rollers 30, which are included in the machine proper, not only support the weight of the pipe but they act in opposition to hold-down rollers 44 which are desirably identical in design and construction to the rollers 30.

The conjoint action of the rollers 30 and 44 positively assures the correct positioning of the pipe at the point where rotary, wire cleaning brushes 46, driven by electric motors 48, engage the pipe for cleaning it.

Since pipes of different diameters have to be dealt with, it is important that the rollers 44 be made vertically adjustable. Through such adjustment, pipes of different diameters can be caused snugly to fit between the supporting rollers 30 and the hold-down rollers 44.

To this end, bearing members 50, similar to roll bearing members 34, are provided for the individual hold-down rollers 44. One pair of the bearing members 50 is supported with capacity for individual adjustment about a horizontal axis from an arm 52 while the other pair is similarly supported from an identical horizontal arm **52*a*. Since the structures, mountings and adjustment of the arms 52 and 52*a* are identical, a description of the mounting and adjustment of 52** will suffice for both.

Plates 54, affixed to one of the frame posts 12, carry fixed pivot pins 56 and 58 for supporting two parallel links 60, 62, of equal length. The links are pivotally connected through pivot pins 64 and 66 to a block 68.

The block 68 has rigidly affixed to it an arm 52 by which one pair of rollers 44 is rotatively carried. A headed screw 72 serves to adjust vertically the block 68 and the arm 52 and thereby fixedly to adjust the height of the hold-down rollers 44, carried by the arm 52, in accordance with the diameter of the pipe being cleaned.

It is essential that provision be made for driving the pipe longitudinally, in opposite directions, past the brushing or cleaning station and at the same time rotating the pipe, the rate of rotation relative to the rate of longitudinal travel being adjustable in accordance with the diameter of the pipe, and with the observed effect of the cleaning brushes on the pipe.

The pipe is both driven longitudinally and rotated from a reversible electric motor 74. The motor, through pulleys 76, drives belts 78, and the belts, in turn, drive larger pulleys 80, the pulleys 80 being affixed to the upper ends of vertical shafts 82. The lower ends of shafts 82 have fast upon them pulleys 84 which, through belts 86, drive slanted pulleys 88 fast on slanted shafts 90. At their upper ends the shafts 90 have fast upon them slanted rubber discs 92 slanted upward at a five degree tilt by means of which the pipe is rotated and at the same time is driven lengthwise in either direction, as desired, depending upon the direction of drive.

It is desirable to vary the relationship of rate of lengthwise travel to rate of rotation. In this way a pipe of large diameter may be caused to advance more slowly than pipe of small diameter so that the larger circumferential surface of large diameter pipe may get more brushing per unit of advance, roughly in proportion to the relative circumferential measures of large and small pipes being cleaned.

Provision is therefore made for raising and lowering the pipe driving rubber discs 92 and 93 and for shifting them laterally. To this end the motor 74 and the mechanism driven by it, including the discs 92 and 93, are carried by a frame 94, which frame is adjustable both vertically and laterally. The frame 94 is borne by a lever arm 96 which is pivotally supported at one end by a stationary cross-shaft 98. The arm 96 and the frame 94 supported by the arm are sustained by an upwardly directed screw 100. An adjusting handle 102 is affixed to the screw 100 and may be operated to raise or lower the frame 94 and hence to raise or lower the pipe driving discs 92 and 93.

Figure 7:
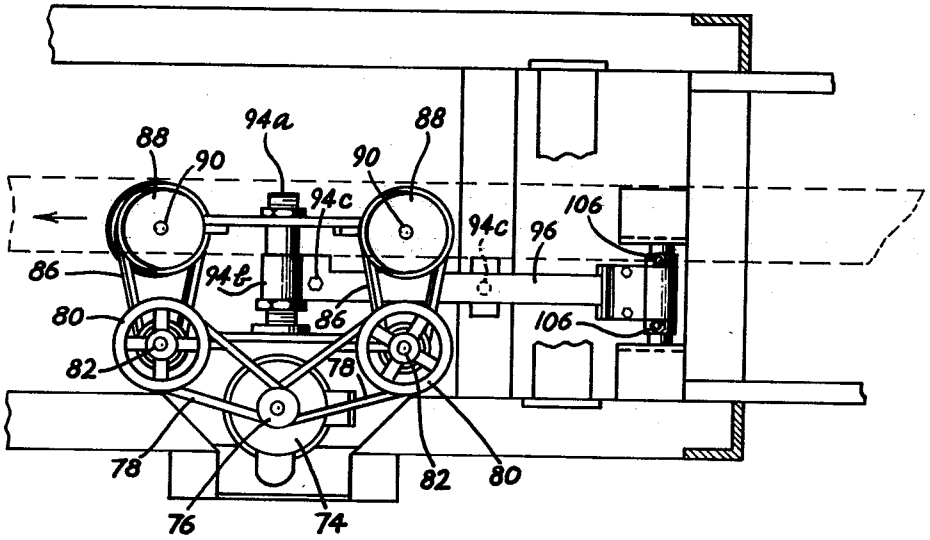
FIG. 7 is a fragmentary plan view of the pipe driving and rotating means.

Because the disc 92 will be moved upward and downward more than the disc 93 in response to operation of the screw handle 102 to raise or lower the arm 96, a leveling means is provided to compensate for this tendency. This is done by providing a leveling means that will cause the discs to apply equal pressure to the pipe. This is done by mounting shaft **94*a* (FIG. 7) in a clamp 94*b*. The pressure of the clamp may be relieved by backing off a screw 94*c*. This permits the discs to be leveled by a rocking movement of the shaft 94*a*, after which the level relationship is maintained by tightening the screw 94*c***.

The discs 92 are shifted laterally along with the entire disc driving unit, including the motor 74, the motor mount and everything operated by the motor, by lateral adjustment of the arm 96. The arm 96 is mounted on the shaft 98 between rings 106, which rings are adjustably secured on the shaft 98 by set screws.

The marginal faces of the pipe driving discs, being of rubber-like flexible material, are adapted to conform to the contour of the pipe through elastic deformation.

Provision is made for adjusting the brushes 46 and their operating motors 48 in accordance with the requirements of pipes of various diameters ranging from a minimum of, say, a half inch, to a maximum of, say, four inches.

To this end the brushes 46 with their motors 48 are supported at different levels on the lower ends of long and short arms 108 and 109, the connection between each motor 48 and its supporting arm 108 being a rigid one. The arms 108 are pivotally connected at their upper ends to opposite ends of a pivoted lever or block 110, the latter being pivotally supported through a shaft 112 from a movable block 114. Screws 116 threaded through block 114 serve to tilt the block 110 to a chosen fixed position for locating the brushes at different levels.

A screw 120 threaded through the block 114 and bearing at its lower end against the upper face of a fixed cross-bar 122 of the frame serves to raise and lower the brushes in unison.

Each of the brushes can be individually adjusted in or out by adjusting its carrying arm 108 or 109, as the case may be, in or out.

In each instance a chain 124 is connected at one end to the carrying arm and at the opposite end to a screw 126. A nut 128, threaded on the screw 126, bears against a frame member 129 and serves to draw the associated member 108 or 109, as the case may be, outward as the nut is turned to shorten the effective length of the screw. When the nut is turned in the opposite direction, the effective length of the screw 126 is increased. The affected arm 108 or 109 swings inward toward the center of the pipe under the influence of gravity as the effective length of the screw is increased.

The chains prevent the brushes from moving close enough to one another to prevent the admission of the pipe between the brushes as the pipe is fed into the machine. Normally the brushes will back off about one-eighth inch as the pipe is inserted between them.

I have described what I believe to be the best embodiment of my invention. What I desire to cover by letters patent, however, is set forth in the appended claims.

I claim:

1. A machine for removing dirt and/or rust from the exterior of pipe which includes (a) pipe supporting and guiding means;

(b) frictional, rotary pipe driving discs having marginal, deformable lateral face portions of substantial width engageable with the exterior of a pipe for rotating the pipe while scrubbing it and driving it lengthwise;

(c) driven rotary brushes engageable with the outer surface of the rotating pipe;

(d) means for adjusting said pipe driving discs to alter the number of pipe revolutions for a given extent of lengthwise feeding according to the diameter of the pipe and/or the observed need for increasing or diminishing the measure of cleaning treatment of the pipe; and (e) motor means constructed and arranged to drive the brushes and the frictional rotary pipe driving discs, in which the pipe supporting and guiding means is an essentially frictionless organization composed of a series of paired idler rollers, the rollers of each pair being of substantial length, divergently related, and inclined upward toward their more widely spaced ends.

2. A machine as set forth in claim 1 in which the motor driven discs for rotating the pipe while feeding it lengthwise are adjustable to vary the level at which the discs engage the pipe.

3. A machine as set forth in claim 2 which includes hold-down rollers adapted for adjustment positively to control the position of the pipe where it is being brushed, and means for adjusting said hold-down rollers to accommodate pipes of different diameters.

* * * * *

UNITED STATES PATENT OFFICE

CERTIFICATE OF CORRECTION

Patent No. 4,156,949 Dated June 5, 1979

Inventor(s) Lynn J. Ziegelmeyer

It is certified that error appears in the above-identified patent and that said Letters Patent are hereby corrected as shown below:

In the heading of the patent, on page 1, the line [76] should read:

[76] Inventor: Lynn J. Ziegelmeyer, 113 Cottage Street #2A (P. O. Box 1112), Medford, Oregon 97501

Signed and Sealed this

*Eleventh* Day of *September 1979*

[SEAL]

*Attest:*

*Attesting Officer*

LUTRELLE F. PARKER

*Acting Commissioner of Patents and Trademarks*